US008646278B2

(12) United States Patent
Kim et al.

(10) Patent No.: US 8,646,278 B2
(45) Date of Patent: Feb. 11, 2014

(54) CONDITION MEASUREMENT APPARATUS AND METHOD

(75) Inventors: Kwanwoo Kim, Mason, OH (US); Geoffrey David Myers, Simpsonville, SC (US); Venkateswarlu Narra, Greenville, SC (US); Shiva Kumar Srinivasan, Greer, SC (US)

(73) Assignee: General Electric Company, Schenectady, NY (US)

( * ) Notice: Subject to any disclaimer, the term of this patent is extended or adjusted under 35 U.S.C. 154(b) by 117 days.

(21) Appl. No.: 13/023,226

(22) Filed: Feb. 8, 2011

(65) Prior Publication Data

US 2012/0198857 A1 Aug. 9, 2012

(51) Int. Cl.
*G01M 15/14* (2006.01)

(52) U.S. Cl.
USPC ..... 60/803; 60/734; 60/39.24; 60/752; 73/112.01; 73/112.03; 374/117; 374/118; 374/119

(58) Field of Classification Search
USPC ..... 60/39.24, 734, 739, 740, 752, 747, 803; 73/112.01, 112.03; 374/141, 142, 143, 374/117, 118, 119
See application file for complete search history.

(56) References Cited

U.S. PATENT DOCUMENTS 3,341,118 A * 9/1967 Schuss ..... 236/26 R
4,716,719 A * 1/1988 Takahashi et al. ..... 60/773
4,744,670 A * 5/1988 Janssen ..... 374/144
5,116,362 A * 5/1992 Arline et al. ..... 60/734
5,148,674 A * 9/1992 Morris ..... 60/240
6,708,568 B2 * 3/2004 Gleeson et al. ..... 73/756
7,047,747 B2 * 5/2006 Tanaka ..... 60/773
7,331,219 B2 * 2/2008 Deuker ..... 73/113.01
7,464,552 B2 * 12/2008 Sattinger ..... 60/725
7,584,616 B2 * 9/2009 Brautsch et al. ..... 60/773
7,610,746 B2 * 11/2009 Fujii et al. ..... 60/39.281
7,775,052 B2 * 8/2010 Cornwell et al. ..... 60/803
2004/0011050 A1 * 1/2004 Inoue ..... 60/773
2010/0058770 A1 * 3/2010 Ryan ..... 60/776
2010/0132375 A1 6/2010 Tanimura et al.

OTHER PUBLICATIONS

Lucas, M.J. et al., "The Acoustic Characteristics of Turbomachinery Cavities", May 1995, NASA Contractor Report 4671, p. 3-17 to 3-20.*

Sutherland et al., "The Acoustic Characteristics of Turbomachinery Cavities", 1995, NASA Contractor Report 4671, pp. 3-17 to 3-20.*

* cited by examiner

*Primary Examiner* — William H Rodriguez
*Assistant Examiner* — Steven Sutherland
(74) *Attorney, Agent, or Firm* — Cantor Colburn LLP

(57) ABSTRACT

A condition measurement apparatus is provided and includes a gas turbine engine combustor having an end cover, a liner defining a liner interior and a fuel nozzle communicative with the liner interior, the end cover being formed to separate a cold side thereof, which is a relatively low temperature environment, from a hot side thereof, which is a relatively high temperature environment in which the liner and the fuel nozzle are disposed, the combustor being formed to define a fuel flow path extending through piping disposed at the cold side of the end cover by which fuel is deliverable to the fuel nozzle, and a condition sensing device operably mounted on the piping.

15 Claims, 3 Drawing Sheets

CONDITION MEASUREMENT APPARATUS AND METHOD

BACKGROUND OF THE INVENTION

The subject matter disclosed herein relates to a condition measurement apparatus and method.

Modern gas turbine combustors often require Dry Low NOx (DLN) technology to achieve relatively decreased NOx emission levels. One of the key issues with operation of an exemplary DLN combustor, however, is that combustion dynamics tends to occur. Combustion dynamics originates from a coherent interaction of heat release due to flame production in the combustor and an acoustic pressure wave associated therewith and leads to decreased combustor and hot gas path component durability. Dealing with and possibly correcting for combustion dynamics requires, at least, accurate measurements of acoustic pressure amplitude in the combustor.

A common method of measuring acoustic pressure amplitude in the combustor involves the placement of a port through a "hot side" of the combustor liner and locating a sensor at a distance from the sensing location by way of a waveguide or directly mounting the sensor at the sensing port without using the waveguide. In either case, for sensor durability and accuracy, hot side applications require adequate cooling and mounting features which could otherwise be used for premixing with fuel to further decrease NOx emissions.

BRIEF DESCRIPTION OF THE INVENTION

According to one aspect of the invention, a condition measurement apparatus is provided and includes a gas turbine engine combustor having an end cover, a liner defining a liner interior and a fuel nozzle communicative with the liner interior, the end cover being formed to separate a cold side thereof, which is a relatively low temperature environment, from a hot side thereof, which is a relatively high temperature environment in which the liner and the fuel nozzle are disposed, the combustor being formed to define a fuel flow path extending through piping disposed at the cold side of the end cover by which fuel is deliverable to the fuel nozzle, and a condition sensing device operably mounted on the piping.

According to another aspect of the invention, a condition measurement apparatus is provided and includes a gas turbine engine combustor having a casing, a liner disposed in the casing and formed to define an interior and a fuel nozzle communicative with the liner interior, the casing including an end cover formed to separate a cold side thereof, which is a relatively low temperature environment, from a hot side thereof, which is a relatively high temperature environment in which the liner and the fuel nozzle are disposed, and to define an orifice upstream from the fuel nozzle and a manifold by which fuel to be combusted in the liner interior is deliverable to the fuel nozzle via the orifice, piping disposed at the cold side of the end cover to supply the fuel to the manifold and a condition sensing device operably mounted on the piping.

According to yet another aspect of the invention, a method of condition measurement for a gas turbine engine is provided and includes measuring a condition at a cold side of a combustor end cover, measuring the condition at a hot side of the combustor end cover and relating results of the condition measurements at the cold and hot sides of the combustor end cover to one another.

These and other advantages and features will become more apparent from the following description taken in conjunction with the drawings.

BRIEF DESCRIPTION OF THE DRAWING

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
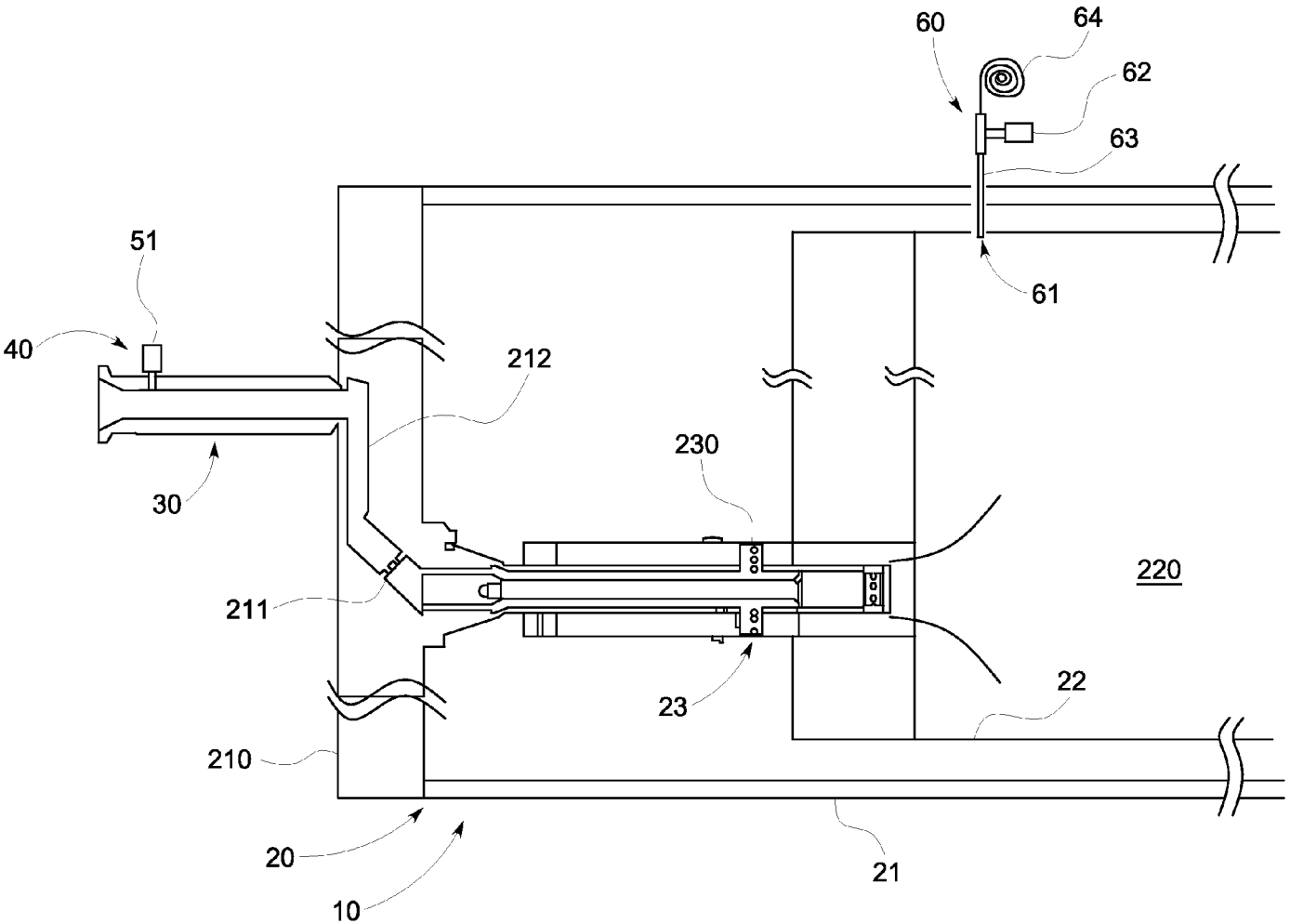
FIG. 1 is a schematic view of a condition measurement apparatus.

With reference to FIG. 1, a condition measurement apparatus 10 is provided. The condition measurement apparatus 10 includes a gas turbine engine combustor 20 having a casing 21, a liner 22 disposed in the casing 21 and formed to define an interior 220 and a fuel nozzle 23. The fuel nozzle 23 is communicative with the liner interior 220 such that fuel delivered to the fuel nozzle 23 can be injected into and mixed with an air flow via fuel injectors 230 with the fuel and air mixture then being supplied to and combusted within the liner interior 220. The casing 21 includes an end cover 210, which is formed to define an orifice 211 upstream from the fuel nozzle 23 and a manifold 212. Fuel to be combusted in the liner interior 220 is deliverable to the fuel nozzle 23 by the manifold 212 via the orifice 211.

The fuel nozzle 23 may be plural in number and may be provided in multiple groups of circuits with the fuel being similarly deliverable to each of the plural fuel nozzles 23. In particular, for a DLN combustor, the fuel nozzle 23 may be provided as a set of six fuel nozzles 23 with one group of one fuel nozzle 23, one group of two fuel nozzles 23 and one group of three fuel nozzles 23.

The end cover 210 may be formed to separate a "cold side" thereof from a "hot side" thereof. As used herein, the "cold side" refers to a relatively low temperature environment. By contrast, the "hot side" refers to a relatively high temperature environment. The liner 22 and the fuel nozzle 23 are both operably disposed within the "hot side" of the end cover 210 with the fuel nozzle 23 extending at least from the end cover 210 to the liner 22.

The condition measurement apparatus 10 further includes piping 30 and a condition sensing device 40. The piping 30 is disposed at the "cold side" of the end cover 210, which as described above is a relatively low temperature environment, and supplies the fuel to the manifold 212. The condition sensing device 40 is operably mounted on the piping 30 and configured to sense a combustion dynamics generated acoustic pressure wave propagating upstream from the liner interior 220. To this end, the condition sensing device 40 may include an acoustic pressure sensor 51 to sense acoustic pressure fluctuations in the piping 30.

In accordance with embodiments and, as shown in FIG. 1, the acoustic pressure sensor 51 may be directly operably mounted on the piping 30. In this case, a wave guide and an infinite or semi-infinite coil may be unnecessary and costs associated therewith avoided. By contrast, in accordance with alternate embodiments and, with reference to FIG. 2, the condition sensing device 40 may further include a wave guide 52 and an infinite or semi-infinite coil 53. The wave guide 52 is operably interposed between the acoustic pressure sensor 51 and the piping 30 and thereby transmits acoustic pressure fluctuations from the piping 30 to the acoustic pressure sensor 51. The infinite or semi-infinite coil 53 is fluidly coupled to the acoustic pressure sensor 51. In the case of the embodiments of FIG. 2, the "cold side" location of the condition sensing device 40 may lead to extended durability and reliability of at least the wave guide 52.

Figure 2:
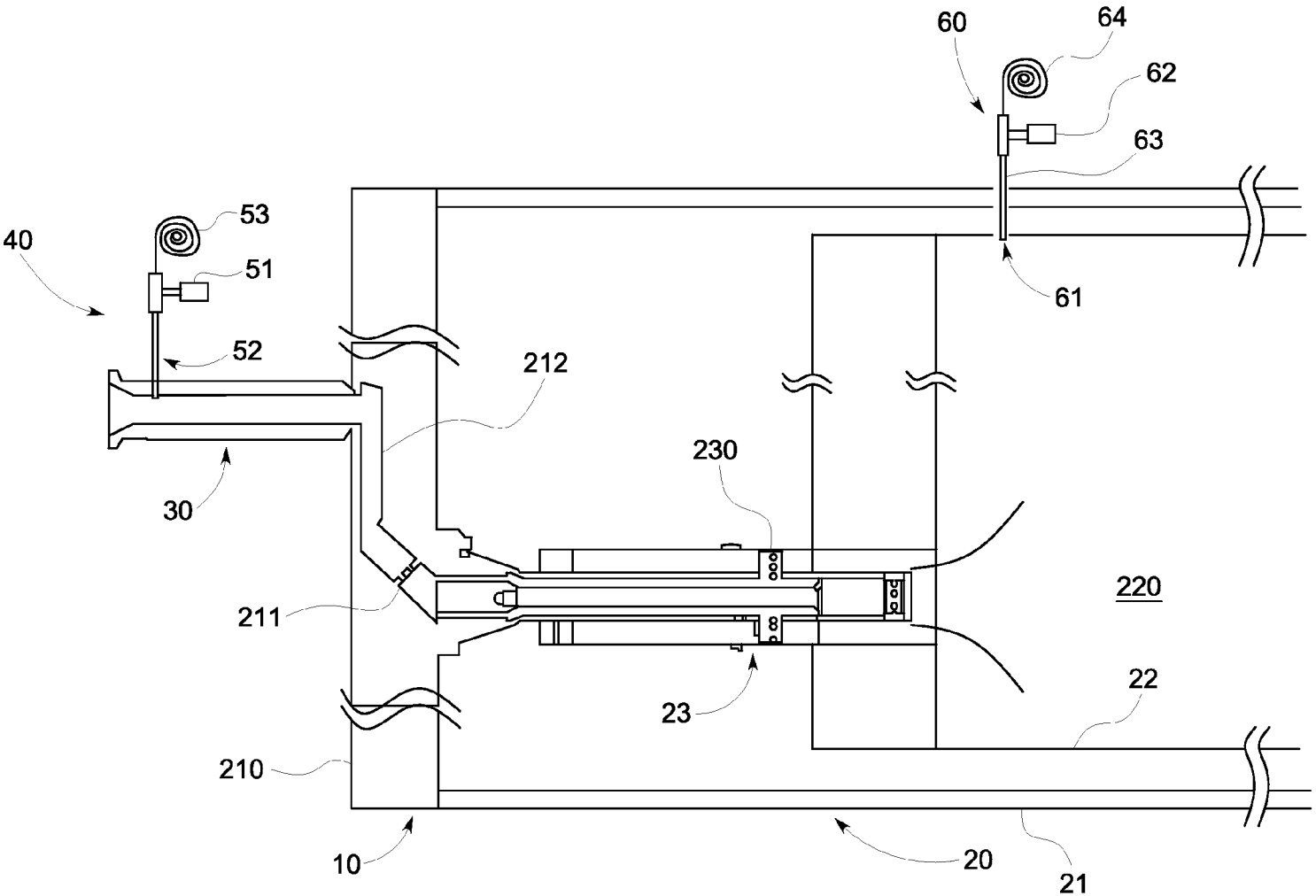
FIG. 2 is a schematic view of a condition measurement apparatus according to alternate embodiments.

With reference to FIGS. 1 and 2, the condition measurement apparatus 10 may further include an additional condition sensing device 60 operably disposed at the "hot side" of the end cover 210, which as described above is a relatively high temperature environment. The additional condition sensing device 60 may be operably mounted on the liner 22 at a sensing hole 61 formed therein and may include an acoustic pressure sensor 62, a wave guide 63 operably interposed between the acoustic pressure sensor 62 and the liner 22 and an infinite coil 64 coupled to the acoustic pressure sensor 62 as described above.

With the condition sensing device 40 sensing acoustic pressures at the "cold side" of the end cover 220 and the additional sensing device 60 sensing acoustic pressures at the "hot side" of the end cover 220, the condition measurement apparatus 10 may be provided with additional advantages beyond those of conventional systems. For example, the condition sensing device 40 may be provided as a backup sensor to detect faulty liner sensor operations, which may occur due to extended exposure to hot gases.

Figure 3:
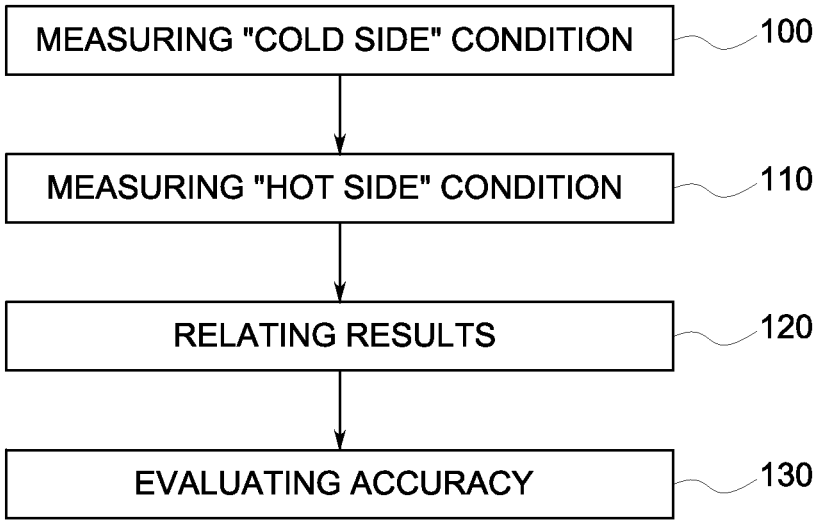
FIG. 3 is a flow diagram illustrating a method of operating a gas turbine engine.

In addition, with reference to FIG. 3, the use of the condition sensing device 40 and the additional sensing device 60 may also provide for a method of condition measurement for a gas turbine engine. The method may include measuring a condition, such as an acoustic pressure, at the "cold side" of the end cover 220 (operation 100), measuring the condition at the "hot side" of the end cover 220 (operation 110) and relating results of the condition measurements at the cold and hot sides of the end cover 220 to one another (operation 120) by, for example, deriving a transfer function describing acoustic pressure amplitude across the end cover 220. The method may further include evaluating an accuracy of the measuring (operation 130), where the evaluating is based on a relationship of results of the condition measurements (i.e., based on the transfer function).

Moreover, by deriving or establishing the transfer function of acoustic pressure amplitude between, for example, a standard liner location (i.e., the location of the additional condition sensing device 60) and an upstream fuel line location (i.e., the location of the condition sensing device 40), use of the waveguide 63 at the standard liner location can be eliminated and cooling air can be used for premixing of more air and fuel, which may help to achieve a relatively decreased NOx emissions level.

Where the fuel nozzle 23 is plural in number and provided in multiple groups of circuits with the fuel being similarly deliverable to each of the plural fuel nozzles 23, one or more of these circuits can be employed to develop the transfer function.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A condition measurement apparatus, comprising:

a gas turbine engine combustor having an end cover, a liner defining a liner interior and a fuel nozzle communicative with the liner interior, the end cover being formed to separate a cold side thereof, which is a relatively low temperature environment, from a hot side thereof, which is a relatively high temperature environment in which the liner and the fuel nozzle are disposed, the combustor being formed to define a fuel flow path extending through piping disposed at the cold side of the end cover by which fuel is deliverable to the fuel nozzle; and first and second condition sensing devices respectively operably mounted on the piping and the liner to sense acoustic pressures in the piping and the liner interior, respectively, such that a transfer function describing acoustic pressure amplitude across the end cover is derivable by relating results from the condition sensing devices.

2. The condition measurement apparatus according to claim 1, wherein the fuel nozzle is plural in number and arranged in one group of one fuel nozzle, one group of two fuel nozzles and one group of three fuel nozzles, the fuel being deliverable to each of the plural fuel nozzles.

3. The condition measurement apparatus according to claim 1, wherein the first condition sensing device senses acoustic pressures propagating in an upstream direction in the piping.

4. The condition measurement apparatus according to claim 1, wherein each of the first and second condition sensing devices comprises an acoustic pressure sensor.

5. The condition measurement apparatus according to claim 4, wherein the first acoustic pressure sensor is directly operably mounted on the piping.

6. The condition measurement apparatus according to claim 4, wherein the first condition sensing device further comprises:

a wave guide operably interposed between the acoustic pressure sensor and the piping; and an infinite or semi-infinite coil coupled to the acoustic pressure sensor.

7. A condition measurement apparatus, comprising:

a gas turbine engine combustor having a casing, a liner disposed in the casing and formed to define an interior and a fuel nozzle communicative with the liner interior, the casing including an end cover formed to separate a cold side thereof, which is a relatively low temperature environment, from a hot side thereof, which is a relatively high temperature environment in which the liner and the fuel nozzle are disposed, and to define an orifice upstream from the fuel nozzle and a manifold by which fuel to be combusted in the liner interior is deliverable to the fuel nozzle via the orifice;

piping disposed at the cold side of the end cover to supply the fuel to the manifold; and first and second condition sensing devices respectively operably mounted on the piping and the liner to sense acoustic pressures in the piping and the liner interior, respectively, such that a transfer function describing acoustic pressure amplitude across the end cover is derivable by relating results from the condition sensing devices.

8. The condition measurement apparatus according to claim 7, wherein the fuel nozzle is plural in number and arranged in one group of one fuel nozzle, one group of two fuel nozzles and one group of three fuel nozzles, the fuel being deliverable to each of the plural fuel nozzles.

9. The condition measurement apparatus according to claim 7, wherein the first condition sensing device senses acoustic pressures propagating upstream from the liner interior in the piping.

10. The condition measurement apparatus according to claim 7, wherein each of the first and second condition sensing devices comprises an acoustic pressure sensor.

11. The condition measurement apparatus according to claim 10, wherein the first acoustic pressure sensor is directly operably mounted on the piping.

12. The condition measurement apparatus according to claim 10, wherein the first condition sensing device further comprises:

a wave guide operably interposed between the acoustic pressure sensor and the piping; and an infinite coil or semi-infinite coil coupled to the acoustic pressure sensor.

13. A method of condition measurement for a gas turbine engine, comprising:

measuring a condition at a cold side of an end cover of a combustor, the measuring of the condition at the cold side being conducted by a first condition sensing device in piping by which fuel is deliverable to the combustor;

measuring the condition at a hot side of the end cover of the combustor, the measuring of the condition at the hot side being conducted by a second condition sensing device on a liner of the combustor;

relating results of the condition measurements at the cold and hot sides of the combustor end cover to one another by derivation of a transfer function describing acoustic pressure amplitude across the end cover; and, with the transfer function derived, eliminating the second condition sensing device.

14. The method according to claim 13, wherein the measuring of the condition at the cold and hot sides of the combustor end cover comprises measuring acoustic pressures.

15. The method according to claim 13, further comprising evaluating an accuracy of the measuring.

* * * * *